US007533661B2

(12) United States Patent
Baasch

(10) Patent No.: US 7,533,661 B2
(45) Date of Patent: May 19, 2009

(54) INTAKE MANIFOLD PLATE ADAPTER

(75) Inventor: Oswald Baasch, Bowling Green, KY (US)

(73) Assignee: Holley Performance Products, Inc., Bowling Green, KY (US)

( * ) Notice: Subject to any disclaimer, the term of this patent is extended or adjusted under 35 U.S.C. 154(b) by 389 days.

(21) Appl. No.: 11/186,848

(22) Filed: Jul. 22, 2005

(65) Prior Publication Data

US 2007/0017492 A1 Jan. 25, 2007

(51) Int. Cl.
*F02B 23/00* (2006.01)

(52) U.S. Cl. ..... 123/585; 123/590

(58) Field of Classification Search ..... 123/585, 123/1 A, 531, 590

See application file for complete search history.

(56) References Cited

U.S. PATENT DOCUMENTS

| | | | |
|---|---|---|---|
| 1,382,285 | A | 6/1921 | Harris |
| 2,574,865 | A | 11/1951 | Edwards |
| 3,680,794 | A | 8/1972 | Romann et al. |
| 3,684,186 | A | 8/1972 | Helmrich |
| RE30,417 | E | 10/1980 | Rand, Jr. |
| 4,448,160 | A | 5/1984 | Vosper |
| 4,494,488 | A | 1/1985 | Wheatley |
| 4,566,634 | A | 1/1986 | Weigand |
| 4,600,151 | A | 7/1986 | Bradley |
| 4,683,843 | A | 8/1987 | Norcia et al. |
| 4,691,672 | A | 9/1987 | Jones |
| 4,798,190 | A | 1/1989 | Vaznaian et al. |
| 4,842,197 | A | 6/1989 | Simon et al. |
| 4,962,889 | A | 10/1990 | Halvorsen |

(Continued)

FOREIGN PATENT DOCUMENTS

AU 2078492 1/1992

OTHER PUBLICATIONS

SEMA News, vol. 34, No. 10, Oct. 2002; p. 80.

(Continued)

*Primary Examiner*—Hai H Huynh
(74) *Attorney, Agent, or Firm*—Hunton & Williams LLP

(57) ABSTRACT

A nitrous oxide plate system having a plate adapted to fit in an intake pathway of an internal combustion engine. The plate has at least one central passage therethrough, and this passage forms a portion of the intake pathway when the plate is installed in the engine. The plate system also has a first spray bar port passing into the central passage, and at least two spray bars that are adapted to be interchangeably installed in the first spray bar port. The at least two spray bars include a first spray bar having a first plurality of distribution orifices having a first total area, and a second spray bar having a second plurality of distribution orifices having a second total area. The second total area is different from the first total area. An interchangeable spray bar for a nitrous oxide plate system is also provided. The interchangeable spray bar has a hollow tube having an interior tube passage, an outer wall, a first end, a second end, and a plurality of distribution orifices passing through the outer wall. The interchangeable spray bar also has a fitting adapted to adjoin the first end of the hollow tube. The fitting has a hollow fitting passage therethrough in fluid communication with the interior tube passage when the fitting is adjoining the hollow tube. The hollow tube is adapted to removably fit within a nitrous oxide plate, and the fitting is adapted to engage the nitrous oxide plate to thereby hold the hollow tube within the nitrous oxide plate.

26 Claims, 9 Drawing Sheets

U.S. PATENT DOCUMENTS

| | | | | | |
|---|---|---|---|---|---|
| 5,035,358 | A | | 7/1991 | Katsuno et al. | |
| 5,046,472 | A | | 9/1991 | Linder | |
| 5,129,381 | A | | 7/1992 | Nakajima | |
| 5,170,766 | A | | 12/1992 | Haas et al. | |
| 5,193,743 | A | | 3/1993 | Romann et al. | |
| 5,211,682 | A | | 5/1993 | Kadowaki et al. | |
| 5,218,824 | A | | 6/1993 | Cederwall et al. | |
| 5,255,658 | A | | 10/1993 | Hoffer et al. | |
| 5,269,275 | A | | 12/1993 | Dahlgren | |
| 5,287,281 | A | | 2/1994 | Meaney | |
| 5,288,021 | A | | 2/1994 | Sood et al. | |
| 5,444,628 | A | | 8/1995 | Meaney et al. | |
| 5,467,926 | A | | 11/1995 | Idleman et al. | |
| 5,482,023 | A | | 1/1996 | Hunt et al. | |
| 5,551,400 | A | | 9/1996 | Rice et al. | |
| 5,605,287 | A | | 2/1997 | Mains | |
| 5,657,733 | A | | 8/1997 | Dozier et al. | |
| 5,699,776 | A | | 12/1997 | Wood et al. | |
| 5,743,241 | A | * | 4/1998 | Wood et al. | 123/531 |
| 5,826,804 | A | | 10/1998 | Reiter et al. | |
| 5,833,141 | A | | 11/1998 | Bechtel, II et al. | |
| 5,839,418 | A | * | 11/1998 | Grant | 123/585 |
| 5,887,799 | A | | 3/1999 | Smith | |
| 5,890,476 | A | | 4/1999 | Grant | |
| 5,967,099 | A | | 10/1999 | Patrick | |
| 6,105,563 | A | | 8/2000 | Patrick | |
| 6,116,225 | A | | 9/2000 | Thomas et al. | |
| 6,260,546 | B1 | | 7/2001 | Vaughn | |
| 6,269,805 | B1 | | 8/2001 | Wilson | |
| 6,279,557 | B1 | * | 8/2001 | Fischer et al. | 123/585 |
| 6,360,714 | B1 | | 3/2002 | Kotooka et al. | |
| 6,378,512 | B1 | | 4/2002 | Staggemeier | |
| 6,453,894 | B1 | | 9/2002 | Fischer et al. | |
| 6,520,165 | B1 | | 2/2003 | Steele | |
| 6,561,172 | B1 | * | 5/2003 | Chestnut et al. | 123/585 |
| 6,691,688 | B1 | | 2/2004 | Chestnut | |
| 6,955,163 | B2 | * | 10/2005 | Grant | 123/585 |
| 2002/0011064 | A1 | | 1/2002 | Crocker et al. | |
| 2002/0162333 | A1 | | 11/2002 | Zelina | |

OTHER PUBLICATIONS

Nitrous Express Next Generation Nitrous System 2003 Catalog; publisher and publication unknown.

Author Unknown, NOS Nitrous Oxide Systems Catalog, http://www.holley.com, Jul. 22, 2005, pp. 1-88, publisher and publication unknown.

Internet Web Page www.nitrousexpress.com/main.html, printed on Jan. 5, 2003, publisher and publication unknown, 1 page.

Internet Web Page www.nitrousexpress.com/whats_new.html, printed on Jan. 5, 2003, publisher and publication unknown, pp. 1-2.

Excerpts of File History of U.S. Appl. No. 10/751,638—Office Action dated Sep. 17, 2004.

Excerpts of File History of U.S. Appl. No. 10/751,638—Preliminary Amendment, Jan. 6, 2004.

* cited by examiner

INTAKE MANIFOLD PLATE ADAPTER

FIELD OF THE INVENTION

The present invention relates generally to internal combustion engine performance enhancers and fuel system modification. More specifically, the present invention relates to an intake manifold plate adapter for providing additional fuel and/or combustion reactants to an internal combustion engine.

BACKGROUND OF THE INVENTION

Nitrous oxide injection systems are known in the art of automobiles for their ability to enhance the power output of internal combustion engines, such as two-stroke, four-stroke, diesel and Wankel rotary engines. Such systems have been used in various applications, including drag racing cars, trucks, motorcycles, snowmobiles, personal watercraft and street vehicles. Nitrous systems have also been used in conjunction with other performance-enhancing devices, such as turbochargers and superchargers.

Known nitrous systems generally operate by introducing a supply of nitrous oxide (chemical formula $N_20$) into the air intake path of the engine combustion chamber of the engine. Nitrous oxide contains about 36% by weight of oxygen whereas air contains only about 21% by weight of oxygen. As such, mixing the oxygen-rich nitrous oxide with the air increases the amount of oxygen available to support the combustion process, and allows a greater amount of fuel to be burned per unit volume of the engine.

The additional fuel required to take full advantage of the use of nitrous oxide may be provided in one of two ways. A first type of system, called a "dry" system, includes a nitrous oxide supply system, and may include various fuel system and/or computer control devices that increase the fuel output of the engine's original fuel delivery system, such as high-flow fuel injectors that replace the engine's stock fuel injectors. Using a dry system, fuel is metered by the engine's regular fuel delivery system (carburetor(s) and/or fuel injector(s)), which may be adjusted or replaced to increase fuel output capacity over that of stock engine fuel delivery components. Dry systems are somewhat limited, however, because they may not be able to introduce enough fuel to react with the oxygen available from high volumes of nitrous oxide. The second type of nitrous delivery system takes advantage of high nitrous oxide flow rates by providing a supplemental fuel delivery system to meter additional fuel to the engine intake path, above and beyond what the original fuel system is capable of delivering. Such systems are called "wet" systems, and typically include a nitrous oxide delivery system as well as a supplemental fuel delivery system that is separate from the engine's original fuel delivery system.

In the descriptions provided herein, the portion of either a wet or dry system that delivers the nitrous oxide is referred to as the "nitrous side" or "nitrous delivery side" of the system, and the portion of a wet system that delivers the fuel is referred to as the "fuel side" or "fuel delivery side." A typical nitrous side includes: a nitrous supply bottle; a valve to control the nitrous flow; various nitrous oxide supply lines comprising stainless steel or plastic tubing, steel-braided hose or the like; a nitrous delivery device located somewhere in the air inlet path of the engine; and may include a pressure regulator. A typical fuel side comprises: a fuel supply (usually the vehicle's regular fuel tank); a fuel pump; a valve to control the fuel flow; a fuel pressure regulator; various fuel supply lines comprising stainless steel, rubber or plastic tubing, steel-braided hose or the like; and a fuel delivery device located somewhere in the air inlet path of the engine. Typical examples of these and other devices are shown and described in catalogs and websites provided by various companies, such as Holley Performance Products of Bowling Green, Ky., Barry Grant Incorporated of Dahlonega, Ga., and Nitrous Express Inc. of Wichita Falls, Tex., and shown in various patents, such as U.S. Pat. No. 4,494,488 to Wheatley, which is incorporated herein by reference.

Referring to FIG. 1, one particular type of known nitrous plate system 100 uses an adapter plate 102 that fits in the air intake system between the engine's air inlet and the combustion chamber(s). These nitrous systems are often referred to as "plate" systems. The adapter shown in FIG. 1 is intended to be fit between the engine's original carburetor (or throttle-body fuel injector or multipoint fuel injection air valve) and the intake plenum, and generally is intended to achieve broad distribution of oxidizer and fuel into the intake manifold. Such adapters are also known to be placed between different sections of multi-piece intake manifolds. To this end, the plate 102 has one or more central passages 104 with associated perimeter walls 106 shaped to smoothly transition from the carburetor or air valve to the intake manifold, and has four holes 108 through which the original or extended carburetor mounting bolts pass to hold the carburetor and plate 102 in place. Various gaskets (not shown) may be used to create an air-tight seal around the plate 102.

The plate 102 is provided with two spray bars: a nitrous spray bar 110 for delivering nitrous oxide, and a fuel spray bar 112 for delivering fuel. The nitrous spray bar 110 is provided with a number of nitrous delivery orifices 114, and the fuel spray bar 112 is similarly provided with fuel delivery orifices 116. The nitrous and fuel delivery orifices 114, 116 are typically provided at particular angles to obtain optimal mixture of the fuel, nitrous oxide and air. To this end, the spray bars 110, 112 are rigidly fixed within the plate 102 so that they can not rotate out of the preferred orientation. This mounting is shown in FIG. 2, in which the ends of the bars 110, 112 are shown permanently bonded with the plate 102 at their ends by an epoxy bond 118. An interference or press fit may also be used to retain the spray bars. Exemplary delivery orifice outlet orientations are shown in U.S. Pat. Nos. 5,839,418 and 6,279,557, which are incorporated by reference herein. It will also be appreciated that prior art nitrous plates can have additional spray bars, such as shown in U.S. Pat. No. 6,561,172, which is incorporated by reference herein.

The nitrous and fuel spray bars 110, 112 are supplied with their combustion reagents through a nitrous fitting 120 and a fuel fitting 122, respectively. As shown in FIG. 2, the nitrous fitting 120 is received in a threaded hole 124 that abuts an open end of the nitrous spray bar 110. A nitrous hose 126 conveys a supply of compressed nitrous oxide nitrous, and is releasably attached to the nitrous fitting 120 by a threaded fitting 128. A nitrous jet 130 is positioned in the nitrous fitting 120 to meter the amount of nitrous oxide that can pass into the nitrous spray bar 110. This arrangement is similar to the one shown in U.S. Pat. No. 6,691,688, which is incorporated herein by reference. A similar arrangement is provided for the fuel side of the system, with a fuel jet 132 being provided to meter the fuel flow. The nitrous and fuel jets 130, 132 typically comprise a billet-machined part having a precision-made orifice 134 of a specific diameter passing therethrough. The orifice 134 acts as a restriction that limits the fuel or nitrous flow rate for a given pressure.

The jets 130, 132 are selected to match one another and to provide the desired power increase to the engine. For example, if more power is desired, the jets are removed and replaced with jets having larger orifices 134. The limit on power production is often based on either the structural integrity of the engine's "bottom end"—that is, the crankshaft, connecting rods, pistons, writs pins, and webs to which these parts are connected—or the vehicle's ability to transfer the power to the ground, which is dictated by the driveline strength, suspension, tires, track conditions, and other factors. Of course, many other factors, such as the engine head integrity, gasket seal strength, and so on, may ultimately limit the amount of additional power that an engine or vehicle can handle. While some consumers customize various engine and vehicle parts to enhance their engine strength and power transfer capability, others do not. As such, current nitrous plate systems are provided with replaceable jets 130, 132 to allow the end-user to select the appropriate jets for his or her particular application.

While the foregoing nitrous plate systems have provided useful power enhancements to internal combustion engines, there still exists a need to provide improvements in this art. As explained herein, the present inventor has provided various improvements over the prior art, and has discovered certain deficiencies with the prior art and novel and inventive ways to address these deficiencies.

SUMMARY OF THE INVENTION

In one embodiment, the present invention provides a nitrous oxide plate system having a plate adapted to fit in an intake pathway of an internal combustion engine. The plate has at least one central passage therethrough, and this passage forms a portion of the intake pathway when the plate is installed in the engine. The plate system also has a first spray bar port passing into the central passage, and at least two spray bars that are adapted to be interchangeably installed in the first spray bar port. The at least two spray bars include a first spray bar having a first plurality of distribution orifices having a first total area, and a second spray bar having a second plurality of distribution orifices having a second total area. The second total area is different from the first total area.

In one embodiment, the first spray bar and the second spray bar are adapted to pass a supply of nitrous oxide or a supply of fuel into the central passage.

In another embodiment, the first spray bar and the second spray bar are fixed against rotation when installed in the first spray bar port.

In still another embodiment, the nitrous oxide plate system has a means to fix the first spray bar and the second spray bar against rotation when installed in the first spray bar port. This means may include a locking fitment between the first spray bar and the plate and the second spray bar and the plate, and the locking fitment may be a jam nut, a set screw, a key, or non-rotatable shape.

In another embodiment, the first spray bar has a first threaded hollow fitting rigidly attached to one end, and a first closure plate rigidly attached to the other end. The first hollow fitting forms a continuous hollow passage into the first spray bar. In this embodiment, the second spray bar similarly has a second threaded hollow fitting rigidly attached to one end, and a second closure plate rigidly attached to its other end. The second hollow fitting forms a continuous hollow passage into the second spray bar. The first and second hollow fittings are interchangeably threadable into the first spray bar port.

In still another embodiment, the nitrous oxide plate system further includes a second spray bar port passing into the central passage; and at least two additional spray bars adapted to be interchangeably installed in the second spray bar port. The at least two additional spray bars include a third spray bar having a third plurality of distribution orifices having a third total area, and a fourth spray bar having a fourth plurality of distribution orifices having a fourth total area. The fourth total area is different from the third total area. In this embodiment, the first and second spray bars may be adapted to pass a supply of nitrous oxide into the central passage, and the third and fourth spray bars may be adapted to pass a supply of fuel into the central passage. Also in this embodiment, at least one of the first, second, third and fourth pluralities of distribution orifices may be round openings and at least an other of the first, second, third and fourth pluralities of distribution orifices may be elongated openings. In still another embodiment, the nitrous oxide plate system may further include a nitrous oxide valve fluidly connectable between the first spray bar port and a supply of nitrous oxide and adapted to control the flow of nitrous oxide therebetween, a fuel valve fluidly connectable between the second spray bar port and a supply of fuel and adapted to control the flow of fuel therebetween, and at least one switch operable to control at least one of the nitrous oxide valve and the fuel valve.

The present invention also provides an interchangeable spray bar for a nitrous oxide plate system. In this embodiment, the interchangeable spray bar has a hollow tube having an interior tube passage, an outer wall, a first end, a second end, and a plurality of distribution orifices passing through the outer wall. The interchangeable spray bar also has a fitting adapted to adjoin the first end of the hollow tube. The fitting has a hollow fitting passage therethrough in fluid communication with the interior tube passage when the fitting is adjoining the hollow tube. The hollow tube is adapted to removably fit within a nitrous oxide plate, and the fitting is adapted to engage the nitrous oxide plate to thereby hold the hollow tube within the nitrous oxide plate.

In one variation on the foregoing embodiment, the interchangeable spray bar has a closure plate that is attached to the second end of the hollow tube to thereby prevent fluid communication therethrough.

In another embodiment, the fitting is adapted to hold the hollow tube within the nitrous oxide plate in an axial direction along a length of the hollow tube, and in a rotational direction around a circumference of the hollow tube.

In still another embodiment, the distribution orifices are round, oblong, rectangular or a combination thereof.

In yet another embodiment, the fitting is rigidly connected to the first end of the hollow tube to thereby prevent independent axial or rotational movement between the fitting and the hollow tube. In this embodiment, the fitting may further have a first threaded portion adapted to threadingly engage a corresponding threaded hole in the nitrous oxide plate. Also in this embodiment, the fitting may further have a second threaded portion adjacent the first threaded portion, and the interchangeable spray bar may further include a jam nut that is adapted to threadingly engage the second threaded portion. In other variants of this embodiment, the fitting may have an integral nut, and may have a third threaded portion adapted to threadingly engage a nitrous oxide supply hose fitting.

In still another embodiment of the interchangeable spray bar, the interior tube passage may have a cross-sectional area that varies between the first end and the second end of the hollow tube. In one variant, the cross-sectional area decreases toward the second end of the hollow tube.

In still another embodiment of the interchangeable spray bar, the plurality of distribution orifices have at least two orifices that have different sizes from one another.

Additional objects, features and advantages of the preferred embodiments will become apparent from the drawing figures together with the detailed description of the preferred embodiments.

DETAILED DESCRIPTION OF PREFERRED EMBODIMENTS

Figure 1:
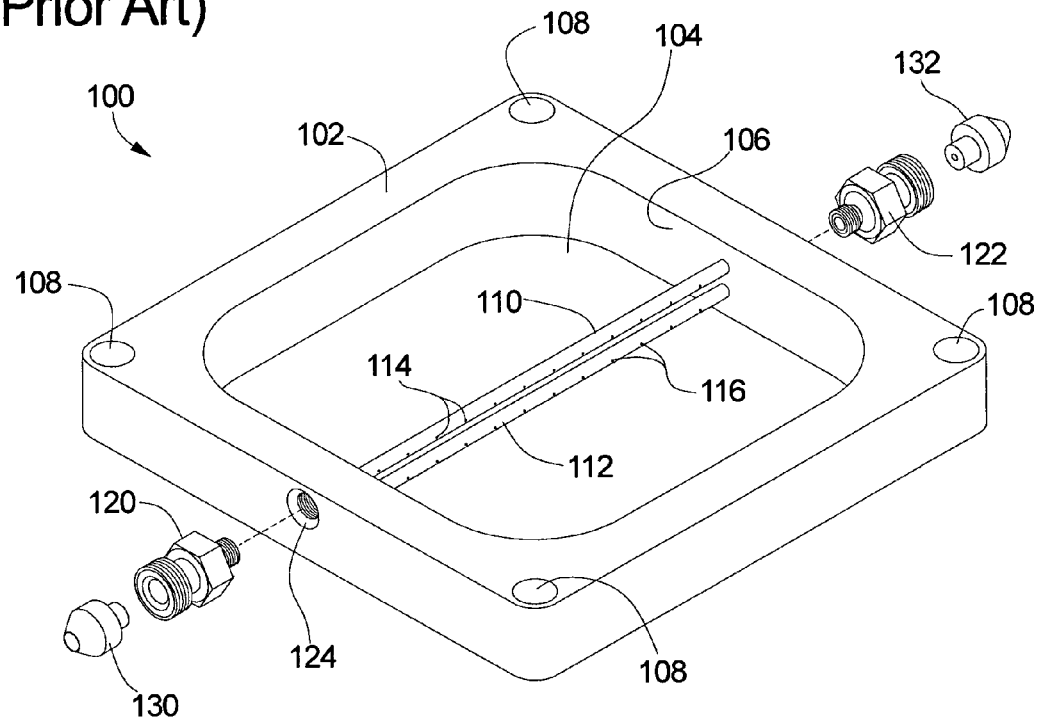
FIG. 1 (Prior Art)
FIG. 1 is an exploded isometric view of a prior art nitrous plate system.

The present invention provides a nitrous plate system that can be used in carbureted, throttle-body fuel injected, multipoint fuel injected (electronic or mechanical), or diesel engines. In a typical carburetor or throttle-body fuel injection application, the nitrous plate system can be installed between the carburetor or throttle-body and the intake manifold. In multipoint fuel injected and diesel engines, the nitrous plate system may be installed between the air filter and the intake manifold. However, in any installation, the nitrous plate system may be adapted to fit in any location within the intake flow path, and the exemplary installations described above are not intended to limit the manner in which a nitrous plate system of the present invention can be installed in an engine. Furthermore, the nitrous plate system may also be used with engines having other fuel delivery systems, as will be appreciated by those of ordinary skill in the art.

The term "engine," as used herein, refers to any type of internal combustion engine, such as two- and four-stroke reciprocating piston engines and rotary engines (e.g., Wankel-type engines) having one or more cylinders or combustion chambers. Such engines may be used to propel vehicles, such as automobiles and other land vehicles, industrial equipment, watercraft and aircraft, and may be used in various stationary applications, such as power generation, pumping, and other industrial uses. Although the present invention is particularly suited to provide increased power in automotive applications, embodiments of the invention may be used to provide benefits in any other application when an intermittent or continuous increase in power output is desired for an internal combustion engine, whatever the application.

As used herein, the terms "nitrous oxide" and "nitrous" refer to a substance having the chemical composition $N_2O$, or blends of $N_2O$ and other substances, but it will be understood that these substances can be replaced by any other suitable oxidizer that may be used to enhance engine performance. The term "fuel" refers to any composition having combustible substances therein, the combustion of which can be used to provide power to an engine. Examples of fuels include gasoline, diesel fuel, natural gas, propane, alcohol, blends of these fuels, and so on. The term "combustion reactant" is understood to encompass any substance that may be used as part of a chemical combustion reaction, including, for example, air, oxygen carriers (such as nitrous oxide), and fuels.

The present invention provides a new plate adapter system for providing nitrous oxide and, optionally, additional fuel to and engine's intake path. The inventor has discovered that a significant problem with prior art nitrous plate systems has been that they are difficult to adjust to provide different nitrous and fuel flow rates. Furthermore, even when the plate systems are manufactured to be adjustable, which is done by inserting an orifice jet in each fuel and nitrous flow supply to limit its flow rate, the use of such adjustments has been found to result in inefficient and/or irregular fuel and nitrous flow and mixing.

Referring back to FIGS. 1 and 2, it is believed that the flow and mixing problems of conventional adjustable nitrous plate systems 100 stem from the fact that typical nitrous and fuel spray bars 110, 112 are manufactured such that they can operate with jets having many different sizes. A typical nitrous plate system 100 is sold to the consumer with a selection of jets 130, 132 having a range of jet sizes, and the consumer selects a nitrous jet 130 and a fuel jet 132 having the sizes most suitable for the particular requirements of the consumer's engine or vehicle and the desired power increase. The jet's "size" is a measure of flow rate that the jet allows for a given fuel on nitrous inlet pressure, and is generally regulated by varying the diameter of the orifice 134. Larger orifices allow greater nitrous and fuel flow rates, and smaller orifices reduce the flow rates. Unless stated otherwise, the flow rate is understood herein to refer to the volumetric or mass flow rate, not the flow velocity.

To account for the potential range of jet sizes that the nitrous plate system 100 may have to accommodate, the delivery orifices 114, 116 of conventional spray bars 110, 112 are manufactured to be large enough to handle the largest anticipated total flow rate provided by the interchangeable jets. Using the nitrous side of the system as an example, in a typical prior art device this is done by making sure that the total combined cross-sectional area of the nitrous delivery orifices 114 is equal to or greater than the cross-sectional area of the largest nitrous jet orifice 134. Under this prior art regime, the jet orifice 134 must always be the point of greatest flow constriction in the system because, if the combined area of the delivery orifices 114 were less than the area of the orifice 134, then the delivery orifices 114 would become the point of greatest constriction and will act to limit the total nitrous flow, rather than the jet 130. In such a case, replacing the jet 130 with larger jets would have no effect on power output. For example, if the largest nitrous jet 130 has an orifice size of 0.120 inches, which is an area of about 0.011 square inches, then the combined area of the nitrous delivery orifices 114 is manufactured to match or exceed this area. In practice, manufacturers typically greatly oversize the delivery orifices 114. For example, a nitrous spray bar 110 having a total orifice area of 0.012 $in^2$ may be used to accommodate nitrous jets having an area of about 0.0016 $in^2$ (0.045 inch orifice) to about 0.0079 $in^2$ (0.100 inch orifice). Similar considerations are present when designing the fuel spray bar.

Figure 2:
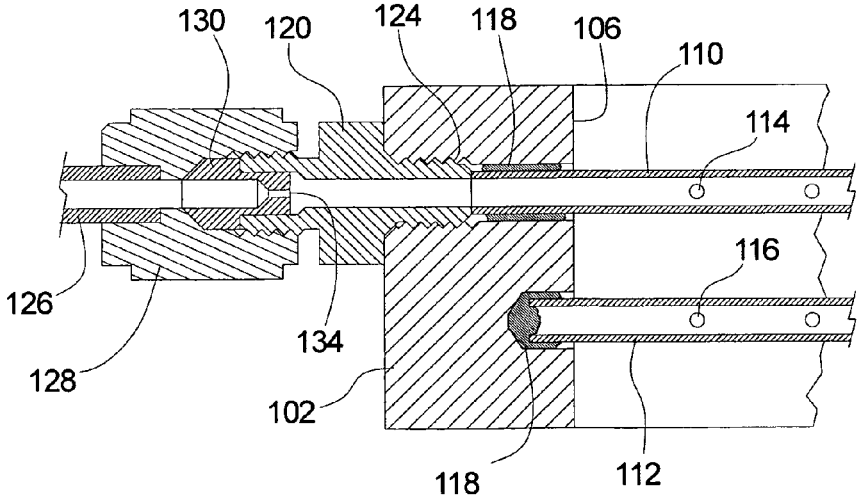
FIG. 2 (Prior Art)
FIG. 2 is a fragmented cross-sectional view of the prior art nitrous plate system of FIG. 1.

While the use of oversized fuel and nitrous delivery orifices 114, 116 is useful (and necessary) for allowing the flow rate to be adjusted using conventional jets, it has been discovered that this configuration has problematic side effects. One side effect is that the nitrous must pass through a series of constricting and expanding passages before exiting the delivery orifices 114 into the engine intake. As shown in FIG. 2, the nitrous is delivered to the plate 302 by way of the hose 126. Depending on the nitrous bottle pressure and pressure losses in the system, the nitrous oxide can be in a 100% liquid state, a combined liquid and gaseous phase, or a 100% gaseous state. The hose 126 has a relatively large cross-sectional area and allows a high flow rate. The liquid nitrous then passes through the orifice 134, which constricts the nitrous flow and reduces the flow rate. As the nitrous exits the orifice 134, it expands into the spray bar 110, which has a larger cross-sectional area than the orifice 134. This expansion can cause at least a portion of the nitrous to change state and become gaseous, which begins to disrupt the regular flow of the nitrous.

A different problem occurs on the fuel side of the system. As the fuel flows down the spray bar 112, it takes the path of least resistance through the delivery orifices 116 closest to the fuel jet 132, resulting in a greater fuel flow through these orifices 116 than through the orifices further from the jet. This, in turn, causes uneven fuel distribution in the central passage 106 of the nitrous plate 100, and uneven distribution of fuel to the engine cylinders. Such uneven fuel distribution can cause some engine cylinders to operate with a fuel/air ratio that is greater than desired (i.e., to run "rich"), and some cylinders to operate with a fuel/air ratio is lower than desired (i.e., to run "lean"). Not only does this reduce the engine's total power gain, but it also may lead to potential engine damage caused by high temperatures associated with lean operation.

A similar problem occurs on the nitrous side of the system, as the nitrous passes through the nitrous jet 130 and takes the path of least resistance through the nitrous delivery orifices 114 closest to the jet. However, this problem is mitigated to some degree by rapid expansion of the compressed nitrous oxide gas within the nitrous spray bar 110, which tends to equalize the pressure of the nitrous within the spray bar 110 and lead to more even nitrous distribution. Regardless, uneven nitrous distribution is still a problem during transient operating conditions, such as when the nitrous first begins to flow into the spray bar 110.

Generally speaking, the present invention addresses these and other issues by providing a nitrous plate system having replaceable spray bars. In the present invention, the spray bar delivery orifices, rather than the jets, provide the primary constriction point for the nitrous or fuel flowing therethrough. Each spray bar is provided with delivery orifices having a total area selected to provide a particular level of power enhancement, and the nitrous plate is tuned by removing and replacing the entire spray bars, rather than just the jets, as in previous designs. As such, the present invention includes, in one aspect, a nitrous oxide kit in which a plate is provided with multiple interchangeable nitrous and/or fuel spray bars, each having a different total delivery orifice area. While jets may still be used with the device for fine tuning, for emergency flow rate changes, or for flow restriction remote from the nitrous plate itself (such as at the nitrous supply bottle), it is preferred that the nitrous and fuel delivery sides of the system be entirely jetless (or just the nitrous side, if the system is a dry system). These and other features of the present invention will now be described in detail by way of non-limiting examples of preferred embodiments of the invention.

Figure 3:
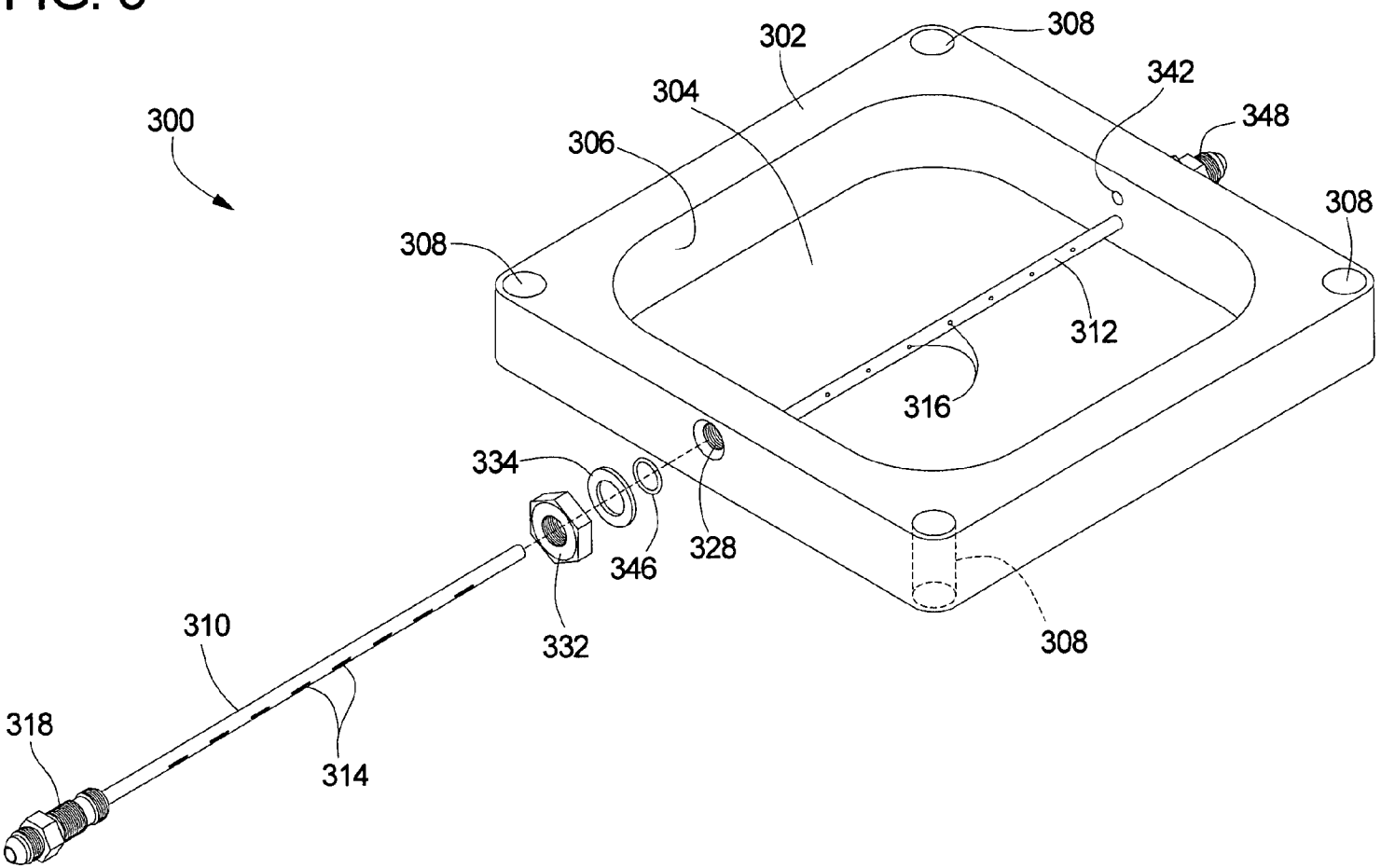
FIG. 3 is an exploded isometric view of a nitrous plate system of the present invention.

A first embodiment of a nitrous plate system 300 of the present invention is illustrated in FIG. 3. The plate system 300 comprises a plate 302 having a central passage 304 defined by a perimeter wall 306. The plate 302 may be provided with holes 308 that align with the manifold, carburetor or throttle-body bolts of the engine (not shown) to which the plate system 300 is to be attached. The plate 308 can thus be securely fastened between the carburetor, throttle-body or air valve and the intake plenum. The perimeter wall 305 is preferably shaped to provide a smooth transition between the parts, and may comprise multiple separate passages through the plate 302, such as shown in U.S. Pat. No. 6,691,688, which is incorporated herein by reference. Suitable gaskets may be provided to provide an air-tight union between the plate 302 and the parts between which it is sandwiched. It will be appreciated that the locations of the holes 308 and the particular shape of the plate 302 and the perimeter wall 306 can be varied to match any number of engine intake systems. It will also be appreciated that the plate 302 may be located in locations other than between the carburetor or throttle-body and the intake plenum. For example, the plate 302 may be located between manifold sections of an intake plenum, between an intake manifold and the engine head, between a supercharger and an intake manifold, and so on.

The plate system 300 of this embodiment includes a removable nitrous spray bar 310 (shown removed) and a removable fuel spray bar 312 (shown installed). This embodiment provides a single-stage wet nitrous system. It will be appreciated that the fuel spray bar 312 may alternatively be a second nitrous spray bar, such that the plate system 300 can be operated as a two-stage dry nitrous system in which one bar is activated before the other, or a single-stage dry nitrous system in which both bars are activated at the same time. It will also be appreciated that additional fuel and/or nitrous spray bars may be added to make a single-stage system having multiple spray bars for the nitrous and fuel supplies, or a multi-stage system in which one nitrous spray bar and one fuel spray bar are activated prior to the other nitrous and fuel spray bars being activated. Other variations will be apparent to those of ordinary skill in the art in view of the present disclosure.

The nitrous spray bar 310 comprises a hollow tube having a plurality of nitrous delivery orifices 314. Similarly, the fuel spray bar 312 comprises a hollow tube having a number of fuel delivery orifices 316. The spray bars 310, 312 can be conveniently constructed from round steel or brass tubing, but may be produced from other materials, and may be flattened into ovals, wing-like shapes, or other shapes to improve airflow around them or promote nitrous or fuel flow. The term "tube," as used herein, is not limited to any particular shape, and is intended to include round, ovate, rectangular or any other hollow shape.

Figure 4:
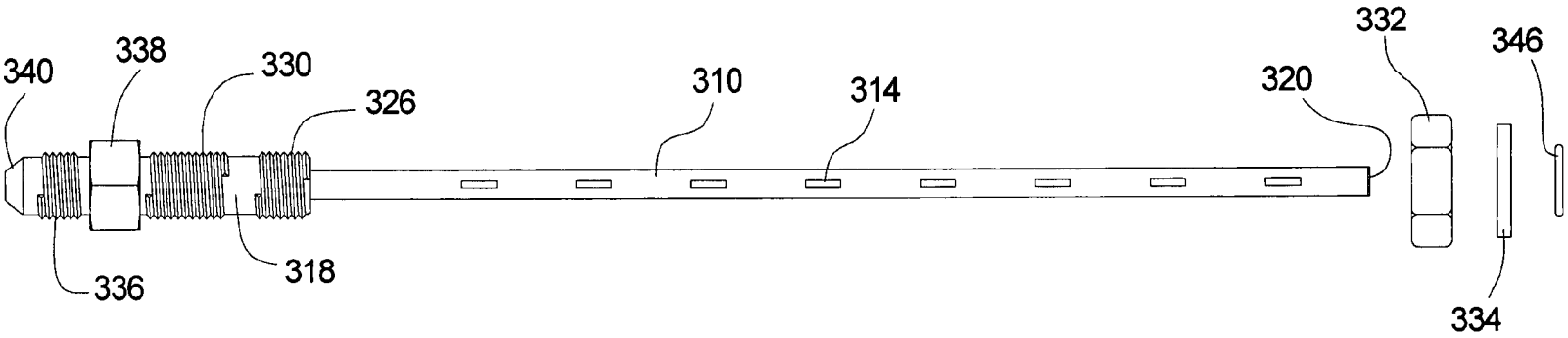
FIG. 4 is a side view of an interchangeable nitrous spray bar of the nitrous plate system of FIG. 3.
Figure 5:
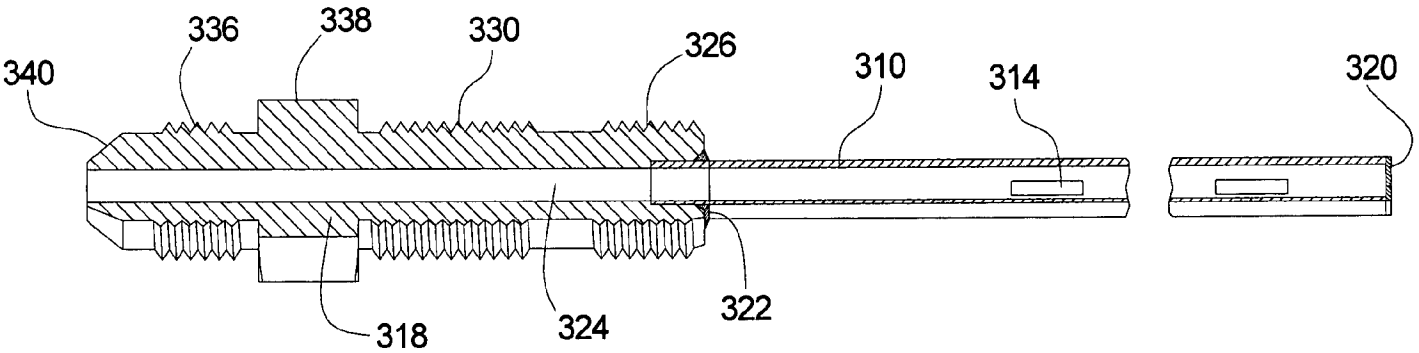
FIG. 5 is a cut away, fragmented view of the interchangeable nitrous spray bar of FIG. 4.

Referring now to FIGS. 4 and 5, the removable nitrous and fuel spray bars 310, 312 are described in more detail. For brevity, only the nitrous spray bar 310 is illustrated and discussed with reference to FIGS. 4 and 5, however the comments herein are equally applicable to the construction of the fuel spray bar 312. The nitrous spray bar 310 of this embodiment is attached at one end to a threaded fitting 318, and at the other end to a closure plate 320. The fitting 318 is used to retain the spray bar 310 in the plate 302 and prevent it from rotating once it is located in the plate 302. Such rotation could reduce the amount of nitrous and fuel atomization and lead to reduced engine performance. The closure plate 320 simply seals the end of the spray bar 310, and may be attached by welding (such as laser, micro-arc, or spin welding), brazing, soldering, epoxy bonding, threaded fastening or in any other generally fluid-tight manner. It is also anticipated that the closure plate 320 may be omitted, provided that end of the spray bar 310 is sealed from the central passage 304 in some manner, such as by locating it against a sealing surface on or in the perimeter wall 306 when the spray bar is installed. For example, the end of the spray bar 310 may be positioned in a blind hole in the perimeter wall having a rubber or silicon sealing surface disposed therein.

As shown in FIG. 5, the nitrous spray bar 310 is attached to the threaded fitting 318 by a weld 322, press fit, slip fit, epoxy bond, threaded fitment, splines or any other type of attachment method. The spray bar 310 adjoins the nitrous fitting 318 along the hollow center axis of the fitting 318, such that a passage 324 through the center of the fitting 318 adjoins the hollow spray bar 310 to provide nitrous thereto.

The threaded fitting 318 of this embodiment may be a so-called "bulkhead" fitting having several distinct threaded portions. A first threaded portion 326 is provided to fit into a spray bar port in the plate 302, which, in this embodiment, comprises a threaded hole 328. A second threaded portion 330 is located immediately beyond the first threaded portion 326 (or simply comprises a continuous extension thereof). A jam nut 332 is provided to threadingly engage with the second threaded portion 330, and may also engage with the first threaded portion 326. A washer 334, having an inner diameter large enough to fit over the first and second threaded portions 326, 330, may also be provided. A third threaded portion 336 of the fitting 318 is located at or near the end of the fitting opposite the first threaded portion 326, and is adapted to threadingly mate with a corresponding hose fitting (not shown) to receive a supply of nitrous oxide. The fitting 318 may also include an integral nut 338 (comprising one or more pairs of opposed, parallel flat surfaces by which the fitting 318 may be grasped by a wrench), or other grasping surfaces (such as knurling), that can be used to hold the fitting 318 to rotate it or prevent it from rotating. The fitting 318 may further include a tapered mating surface 340 to engage with a corresponding surface in the nitrous hose or hose fitting to create a fluid-tight seal therebetween. A fitting of this type may be readily custom-fabricated or obtained from Earl's Performance Plumbing of Rancho Dominguez, Calif.

Figure 6:
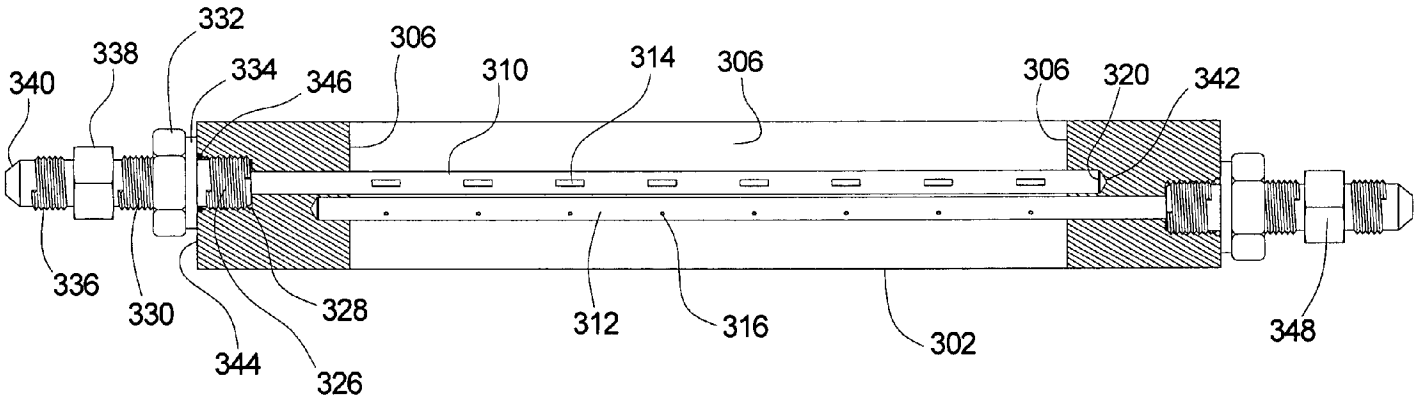
FIG. 6 is a cut away side view of the nitrous plate system of FIG. 3, shown with the interchangeable nitrous spray bar and interchangeable fuel spray bar installed in the plate.
Figure 7:
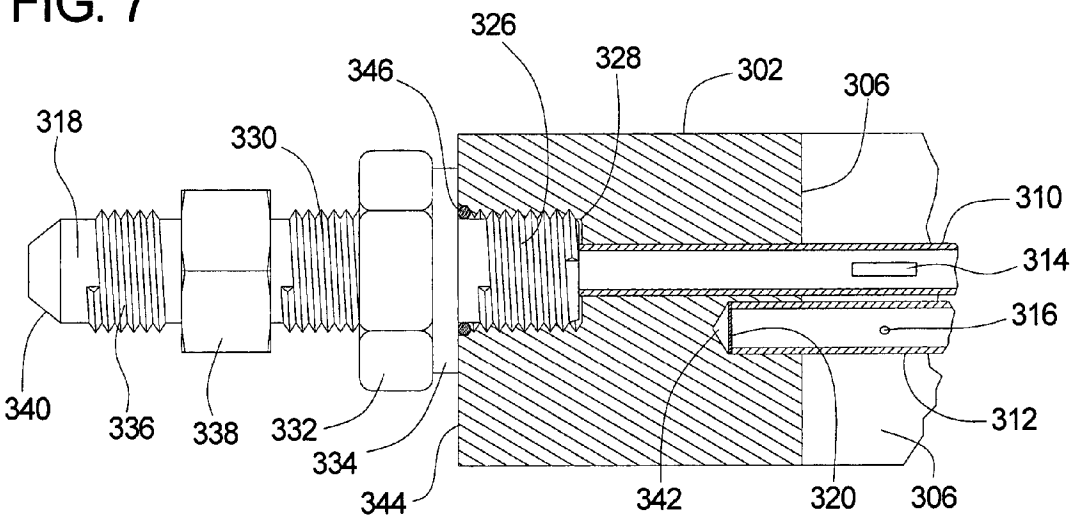
FIG. 7 is a fragmented, view of the left side of FIG. 6, shown enlarged for detail.

It has been found that an important requirement for the replaceable spray bars of certain embodiments of the present invention is that they should be adapted to be installed at the correct angular orientation with respect to the airflow through the central passage 304, in order to maximize the nitrous and fuel distribution and atomization within the engine air intake. One manner of doing this is shown in the embodiment of FIGS. 3 through 7. In this embodiment, the nitrous spray bar 310 is installed into the plate 302 by inserting it through the threaded hole 328 and engaging the first threaded portion 326 with the threaded hole 328, as shown most particularly in FIG. 7. As shown in FIG. 6, the closed end of the spray bar 310 may slide into a corresponding hole 342 in the perimeter wall 306 of the plate 302 to hold it more securely, but it is also envisioned that the spray bar 310 may extend only partly across the central passage, in which case the hole 342 would not be necessary.

Once the spray bar 310 is installed to approximately its full depth into the hole 328, it is oriented such that the nitrous delivery orifices 314 are in the desired angular orientation (as described in more detail later herein). The jam nut 332 then is tightened against an outer wall 344 of the plate 302, while holding the fitting 318 against rotation using the integral nut 338, to thereby lock the spray bar 310 in this orientation and fix it in the plate 302. The nitrous plate 302, fitting 318, and/or spray bar 310 (or other parts) may be provided with markings to help the consumer properly orient the spray bar 310. The washer 334 helps to smoothly fit the jam nut 332 to the outer wall 344, and may comprise a lock ring to help hold the jam nut 332 in place. An o-ring 346 (or any other type of gasket or seal) may also be provided to help form a fluid tight seal between the jam nut 332, the plate 302, and the fitting 318.

After the spray bar 310 and fitting 318 are secured in place by the jam nut 332, a hose containing a supply a nitrous oxide can be threaded onto the third threaded portion 336 of the nitrous fitting 318, and operation can begin. The nitrous spray bar 310 can be quickly removed by simply detaching the nitrous supply hose from the fitting 318, loosening the jam nut 332, and unthreading the fitting 318 from the threaded hole 328.

The fuel spray bar 312 is provided with its own fuel fitting 348, and is constructed, installed and removed in the same manner as the nitrous spray bar 310. The fuel spray bar 312 and/or fuel fitting 348 may be configured to prevent inadvertent installation into the threaded hole 328 intended to receive the nitrous spray bar 310 and fitting 318. This can be done, for example, by making the fuel spray bar 312 with a larger or smaller dimension than the nitrous spray bar 310, such that it does not fit in place, or by making the fittings 318, 348 with different, non-interchangeable thread sizes. In a similar fashion, the nitrous and fuel fittings 318, 348 may also be made such that the corresponding nitrous and fuel supply lines can not be attached to the wrong fitting.

Figure 8:
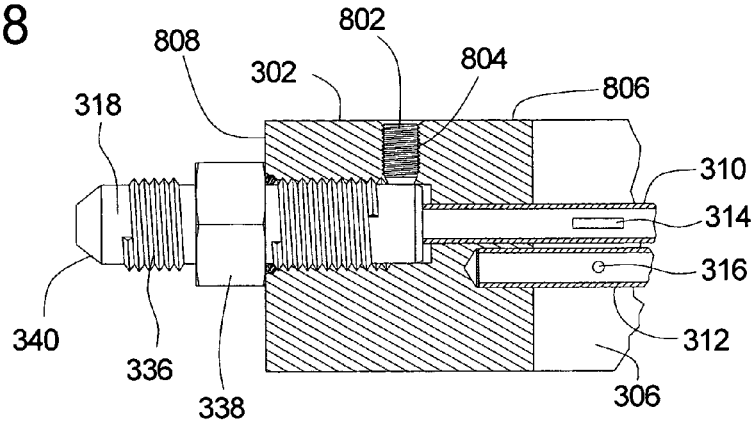
FIG. 8 is a first alternative embodiment of a nitrous spray bar fitment system, shown in a partially cut away and fragmented side view.

While this method of locking the spray bars in the desired angular orientation is preferred, any other methods for doing so should be suitable for use with the present invention. For example, as shown in FIG. 8, the jam nut and washer may be omitted, and the nitrous and fuel fittings 318, 348 may be angularly locked by a set screw 802 that passes through a threaded hole 804 in the nitrous plate 302 and presses against the fitting 318, 348. While the threaded hole 804 is shown in the upper surface 806 of the plate 302, it may instead be located in the outer surface 808 such that it can be engaged while the nitrous plate 302 is installed in an engine.

Figure 9:
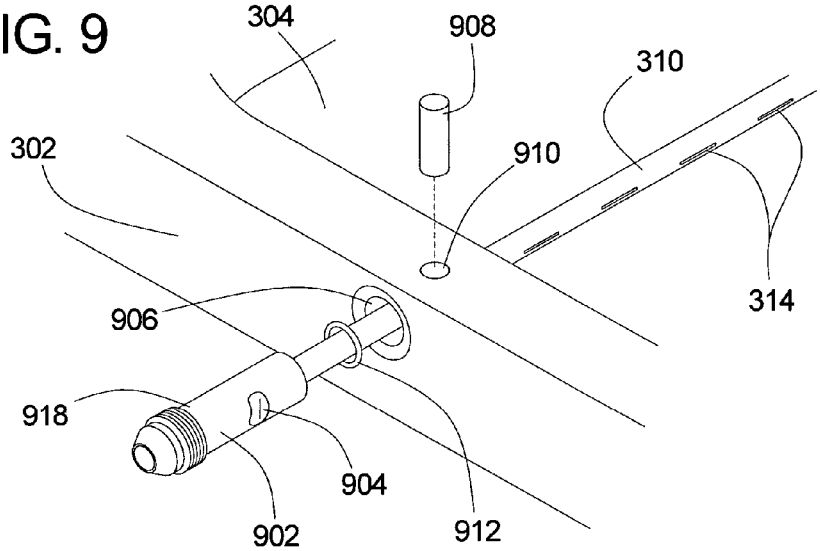
FIG. 9 is a second alternative embodiment of a nitrous spray bar fitment system, shown in an exploded, fragmented isometric view.

In another exemplary embodiment, shown in FIG. 9, the fitting 918 is not threaded into the plate 302, but is instead provided with a smooth cylindrical outer surface 902 having a keyslot 904. The fitting 918 is pushed into a corresponding hole 906 in the plate 302, and a key 908 is inserted through another hole 910 in the top of the plate 302 to hold the fitting 918 and spray bar 310 in place and prevent rotation thereof. The key 908 need not be threaded, as it is held in place by the parts stacked above the plate 302. One or more o-rings 912 or other seals may also be provided to help prevent air, nitrous and/or fuel from leaking through the holes 906, 910 and into the central passage 304 of the plate 302. It will be appreciated that the key 908 of the embodiment of FIG. 9 holds the fitting 918 (and thus the spray bar 310, which is attached rigidly thereto) both axially, so that it does not slide out of the plate 302, and rotationally, so that it does not rotate out of the desired angular orientation.

In a variation of the embodiment of FIG. 9, the fitting 918 and hole 906 may be shaped such that the fitting 918 can not rotate within the hole 906. For example, the fitting 918 and hole 906 may be shaped as circles with one flat side, or as squares. In such a case, the engagement of the fitting 918 and the hole 906 will prevent any rotation of the fitting 918 and the spray bar 310 attached thereto. As such, the key can be designed such that it simply holds the fitting 918 axially within the plate 302. Also in this embodiment, the fitting 918 and hole 906 may be shaped such that the fitting 918 will only fit within the hole 906 in the proper angular orientation, so that accidental mis-orientation of the spray bar 310 is prevented. Such variations will be understood by those of ordinary skill in the art in light of the present disclosure and with routine experimentation with embodiments of the invention.

Figure 10:
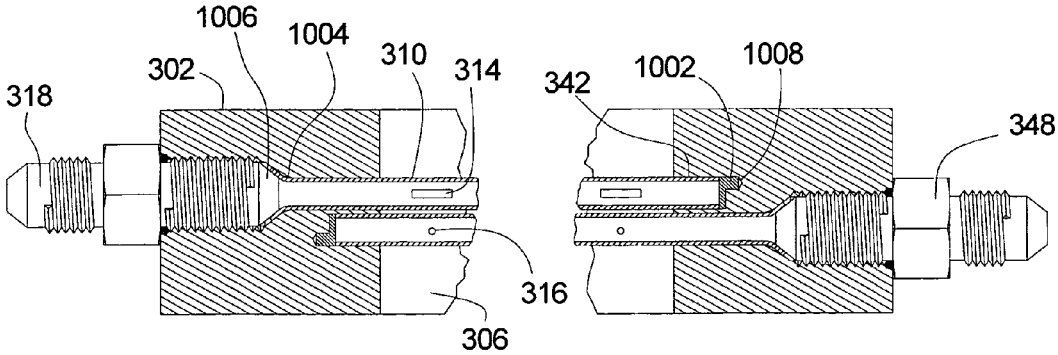
FIG. 10 is a third alternative embodiment of a nitrous spray bar fitment system, shown in a partially cut away and fragmented side view.

While the foregoing embodiments have used spray bars 310 that are attached to the fittings 318 such that they rotate with the fitting 318, it is also possible to have replaceable spray bars 310 that are not rigidly fixed to the fittings 318. For example, in all of the foregoing embodiments, the spray bars 310 may be fitted to the fittings 318 with splines, which prevent relative rotation, but allow some relative axial movement. The spray bar 310 may also be completely separate from the fitting 318, as shown in FIG. 10. In this embodiment, the spray bar 310 is inserted into the plate 302, and held in the desired angular orientation by an offset pin 1002 (or other shaped part) located on the closure plate 320. The spray bar end 1004 adjacent the fitting 318 may be flared, tapered, swaged, or otherwise provided with a sealing surface to mate with a corresponding surface 1006 on the adjacent end of the fitting 318. The offset pin 1002 fits into a corresponding offset countersunk hole 1008 within the hole 342 in the perimeter wall 306 of the plate 302, thereby placing the spray bar 310 in the desired angular orientation, and preventing rotation of the spray bar 310 while the fitting is being threaded into the plate 302.

In the embodiment of FIG. 10, the offset pin 1002, as it fits within the countersunk hole 1008, forms a non-rotatable shape. Of course, other non-rotatable shapes may be used, and the shapes need not be formed on the closure plate 320, but can instead be formed by shaping the spray bar as a non-circular shape that fits into a correspondingly shaped hole 342. In still other variations of this design, the spray bar 310 may be provided with a non-rotatable shape at the end 1004 adjacent the fitting 318, rather than at the end adjacent the closure plate 320. In still further embodiments, the spray bar 310 may not be provided with any feature that prevents rotation, and it may be left to the consumer to manually adjust the spray bar 310 and tighten it into the proper angular orientation with the fitting 318 using simple trial-and-error. This particular embodiment is desirable to reduce part and fabrication cost, but may result in somewhat less accurate installation of the spray bar 310. These and other variations are within the scope of the invention.

Figure 11:
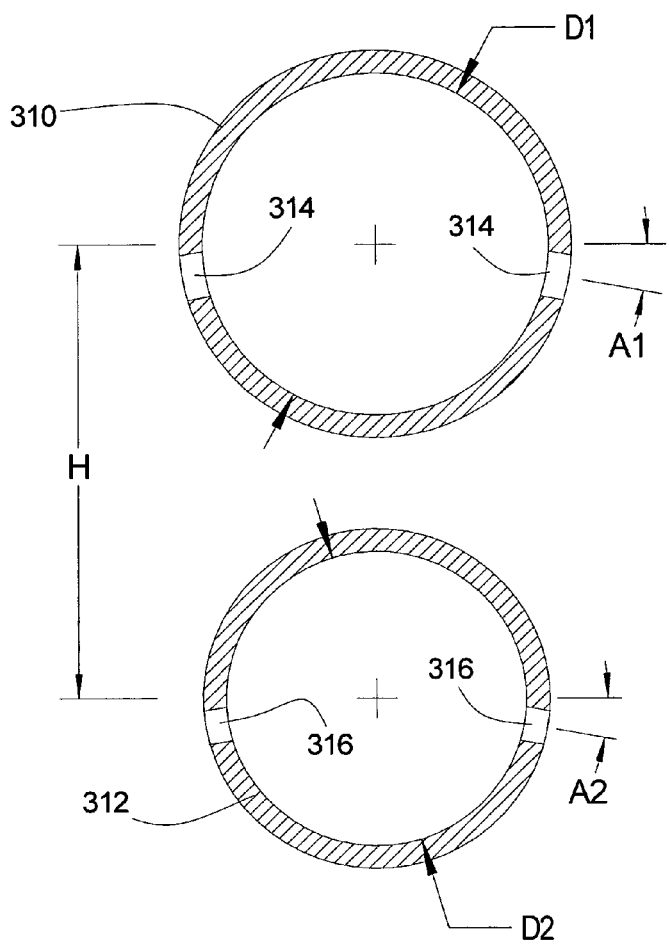
FIG. 11 is a section view of the nitrous spray bar and fuel spray bar of one embodiment of the invention.

Referring now to FIG. 11, a typical desirable angular orientation for the nitrous and fuel spray bars 310, 312 and their respective delivery orifices 314, 316 is shown. In this embodiment, the nitrous spray bar 310, having inner diameter D1, is shown positioned immediately above the fuel spray bar 312, having inner diameter D2. The spray bars 310, 312 have their centerlines spaced by dimension H. The nitrous delivery orifices 314 are oriented at a slight downward angle A1, and the fuel delivery orifices 316 are oriented horizontally, or, in higher power applications, may be oriented slightly downward (as shown) at angle A2. It is also envisioned that the fuel delivery orifices can be angled at an upward angle.

In a preferred embodiment, the nitrous spray bar 310 has an inner diameter of about 0.096 inches to about 0.125 inches, and most preferably about 0.125 inches, and the fuel spray bar 312 has an inner diameter of about 0.096 inches to about 0.125 inches, and most preferably about 0.096 inches. Also in a preferred embodiment, the centerline spacing H of the spray bars 310, 312 is about 0.125 inches to about 0.160 inches, and most preferably about 0.130 inches. Also in a preferred embodiment, the nitrous delivery orifice angle A1 is about 30 degrees downward (i.e., towards the fuel spray bar 312) to about 50 degrees downward, and most preferably about 35 degrees downward, and the preferred fuel delivery orifice angle A2 is about 30 degrees upward (i.e., towards the nitrous spray bar 310) to about 45 degrees downward, and most preferably about 0 degrees (i.e., horizontal).

While the foregoing dimensions are preferred, they are not limiting of the invention, and other angles and dimensions may be used. Indeed, the invention is not limited to any dimensions, locations and orientations of the nitrous and fuel spray bars 310, 312, and the interchangeable spray bars may be positioned in any manner that is found to be useful for enhancing engine performance, regardless of whether the degree of enhancement is most efficient or not. Examples of different delivery orifice orientations and locations include, by way of non-limiting examples, those of U.S. Pat. No. 5,743,241 to Wood et al.; U.S. Pat. No. 5,839,418 to Grant; U.S. Pat. No. 6,279,557 to Fischer et al.; U.S. Pat. No. 6,561,172 to Chestnut et al.; and U.S. Pat. No. 6,269,805 to Wilson, which are all incorporated herein by reference in their entireties. Furthermore, the inside diameters D1 and D2 of the nitrous and fuel spray bars 310, 312, respectively, may be adjusted depending on the desired nitrous and fuel flow rates, and the spray bars may be shaped differently from the shown round shapes, as will be appreciated by those of ordinary skill in the art. The nitrous and fuel spray bars 310, 312 may also be located side-by-side, at an angle to one another, or in an inverted vertical orientation. It is also not absolutely necessary to locate the spray bars adjacent one another at all, although it is believed that doing so increases fuel and nitrous distribution and atomization.

Figure 12:
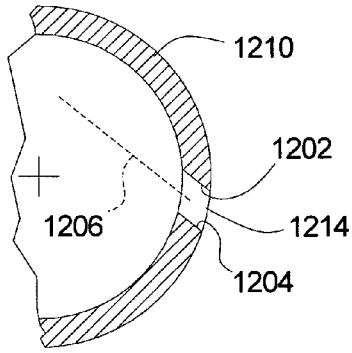
FIG. 12 is a fragmented section view of another nitrous or fuel spray bar of another embodiment of the invention.
Figure 13:
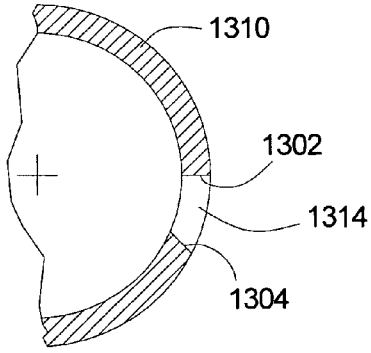
FIG. 13 is a fragmented section view of yet another nitrous or fuel spray bar of another embodiment of the invention.
Figure 14:
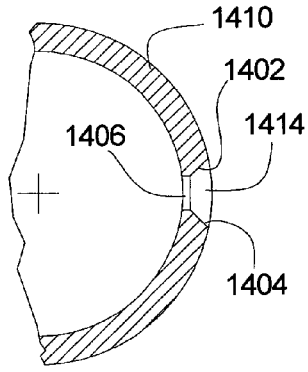
FIG. 14 is a fragmented section view of still another nitrous or fuel spray bar of another embodiment of the invention.

The particular details of the nitrous and fuel spray bars 310, 312 may also be adjusted to provide certain benefits to the present invention. For example, while the fuel and nitrous delivery orifices 314, 316 of FIG. 11 are shown having parallel walls that are generally directed towards the centerline of the respective spray bar 310, 312, other shapes of the nitrous or fuel delivery orifices 314, 316 may be used to enhance nitrous or fuel atomization or mixing. FIG. 12 shows one such embodiment, in which a spray bar 1210 (fuel or nitrous) has a delivery orifice 1214 that has parallel side walls 1202, 1204, but which lie along a path 1206 that does not intersect the centerline of the spray bar 1210. FIG. 13 is a similar variation in which the spray bar 1310 (fuel or nitrous) has a delivery orifice 1314 having non-parallel side walls 1302, 1304. FIG. 14 is yet another variation in which the spray bar 1410 delivery orifice 1414 has a compound shape formed from a portion having non-parallel side walls 1402, 1404, and a portion 1406 having parallel side walls. These or other variations, whether known or later developed, may be used with the present invention.

Figure 16:
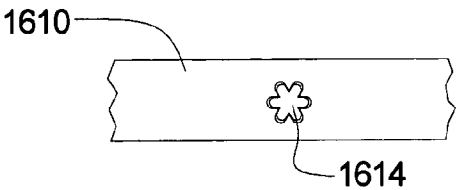
FIG. 16 is a fragmented side view of still another nitrous or fuel spray bar of another embodiment of the invention.
Figure 15:
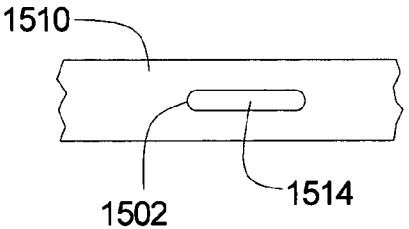
FIG. 15 is a fragmented side view of still another nitrous or fuel spray bar of another embodiment of the invention.

Still other exemplary variations on the geometry of the delivery orifices are shown in FIGS. 15 and 16. While the nitrous delivery orifices 314 have been illustrated herein as being rectangular slots, and the fuel delivery orifices 316 have been illustrated as round orifices, the opposite configuration may be used (rectangular fuel delivery orifices 316 and round nitrous delivery orifices 314). It will also be appreciated that the delivery orifices 314, 316 may have various different shapes, such as: ovals, slits, or rectangles (or other elongated shapes); simple or complex geometric shapes, such as circles, squares, and triangles; simple or complex curved shapes, such as arcs or "s" shapes; or any other shapes or combinations of shapes. There is also no requirement for all of the orifices on a single spray bar to have the same shape as one another, or for the orifices on different spray bars to be different from one another. Exemplary alternative orifice shapes are shown in FIGS. 15 and 16. In the embodiment of FIG. 15, the spray bar 1510 (nitrous or fuel) has rectangular delivery orifices 1514 having rounded ends 1502. In the embodiment of FIG. 16, the spray bar 1610 (nitrous or fuel) has six-lobed delivery orifices 1614 that are tapered such that the area of the delivery orifice 1614 is smaller towards the center of the spray bar 1610. Either of the shapes of FIGS. 15 and 16 can be readily made using laser cutting, EDM (electric discharge machining), high precision piercing, chemical etching, or other accurate cutting techniques, and may provide improved nitrous or fuel atomization or delivery performance. Of course, other shapes may also be used for either spray bar 310, 312.

Figure 17:
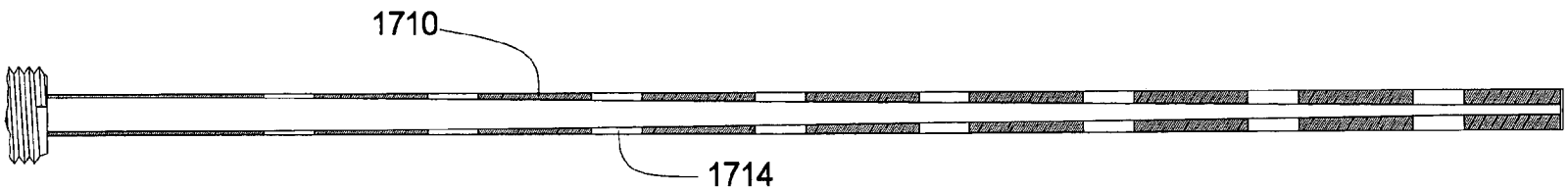
FIG. 17 is a fragmented and cut away top view of still another nitrous or fuel spray bar of another embodiment of the invention.
Figure 18:
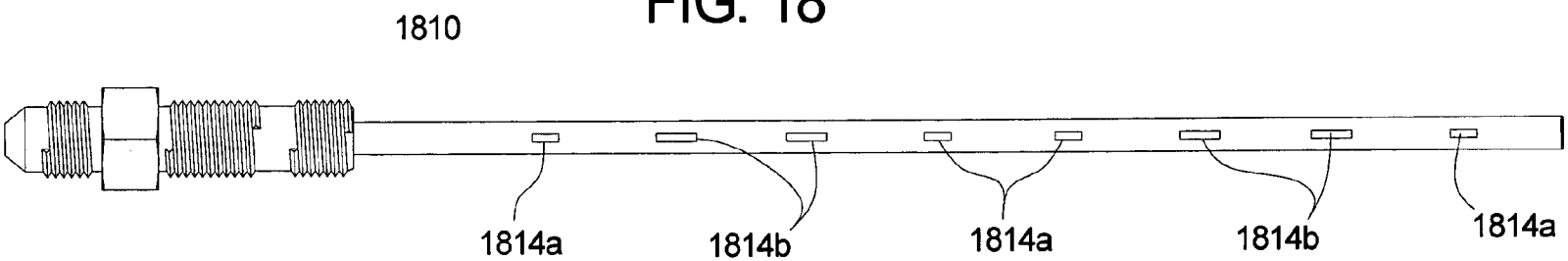
FIG. 18 is a side view of still another nitrous or fuel spray bar of another embodiment of the invention.

FIGS. 17 and 18 show two more variations on the spray bar construction. In the embodiment of FIG. 17, the spray bar 1710 (nitrous or fuel) has a varying inside diameter (either as a gradual change or in steps), but the delivery orifices 1714 are all the same area as one another. This construction may equalize the flow rate during transient operating conditions, such as when the fuel or nitrous initially begins to flow into the spray bar 1710, and may help equalize flow rates during steady-state operating conditions, particularly in the fuel spray bar.

The spray bar may also have delivery orifices of different sizes or shapes to promote higher or lower nitrous or fuel flow rates at particular locations along the spray bar. For example, in the embodiment of FIG. 18, the spray bar 1810 (nitrous or fuel) has two or more different size delivery orifices 1814*a*, 1814*b*. The larger delivery orifices 1814*b* are positioned along the spray bar 1810 to direct greater amounts of nitrous or fuel to portions of the intake manifold where the incoming air has the highest velocity, to thereby enhance the nitrous or fuel distribution and atomization. Other variations will be apparent to those of ordinary skill in the art in view of the present disclosure and with routine experimentation with the inventions described and claimed herein. The embodiments of FIGS. 17 and 18 may also be combined to further control the distribution of fuel or nitrous from the spray bar.

Figure 19:
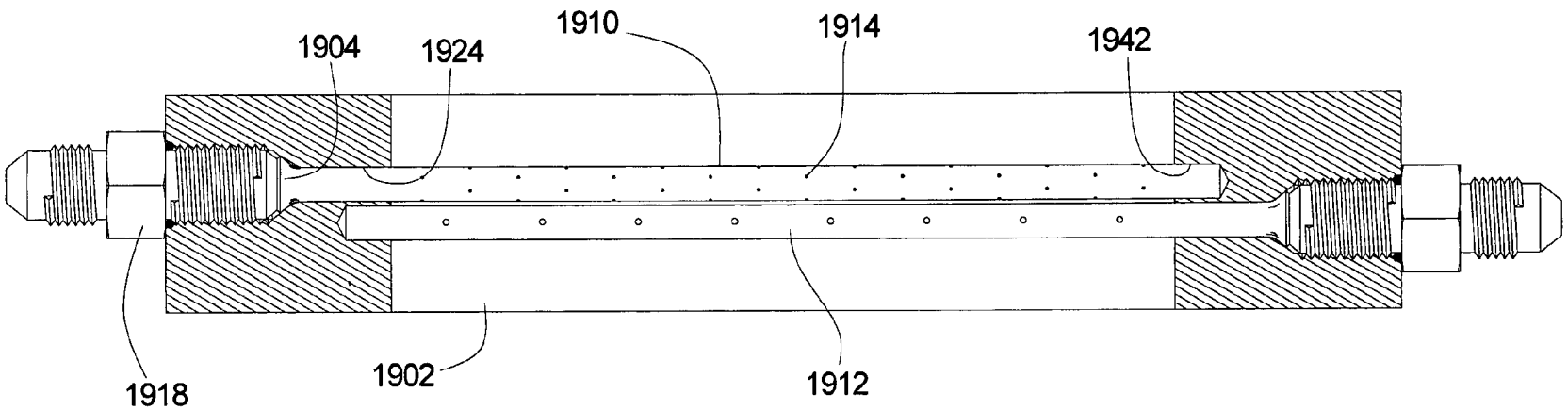
FIG. 19 is a partially cut away side view of still another embodiment of the present invention.

The foregoing embodiments have shown spray bars that are locked in their angular orientation, however this is not strictly necessary for the invention. It is also envisioned that a spray bar can be provided that does not require a particular angular orientation to obtain acceptable nitrous and/or fuel delivery properties. Referring now to FIG. 19, one such embodiment is now described. In the embodiment of FIG. 19, the nitrous spray bar 1910 is affixed in the nitrous plate 1902 much in the same manner as shown in the embodiment of FIG. 10. In this embodiment, the nitrous spray bar 1910 is located through a first hole 1924 on one side of the plate 1902, and terminates in a second, blind hole 1942 in the other side of the plate 1902. The nitrous spray bar 1910 is held in place by a nitrous fitting 1918, and may have a tapered, swaged or flanged end 1904 that abuts a corresponding surface on the fitting 1918 to form a seal.

The nitrous spray bar 1910 of this embodiment comprises a number of nitrous delivery orifices 1914 that are arranged in several offset, radially-and axially-spaced rows around the entire perimeter of the bar. For example, in the shown embodiment, the nitrous spray bar 1910 comprises eight rows of nitrous delivery orifices 1914. Each row has eight nitrous delivery orifices 1914, and the rows are radially spaced from one another around the perimeter by 45 degrees. In addition, the orifices 1914 of each adjacent row are offset along the axial length of the spray bar 1910. As with the other embodiments herein, the total area of the orifices 1914 is selected to provided a particular nitrous flow rate (for a given pressure), and the exact sizes and numbers of the orifices 1914 to provide a desired flow rate can be established by calculation or experimentation. The spray bars 1910 are provided as replaceable parts that can be interchanged to tune the performance of the engine without using conventional jets.

Using this or similar constructions, the nitrous oxide is more evenly emitted around the perimeter of the spray bar 1910, making is less sensitive to changes in angular orientation. A similar construction may be used for the fuel spray bar 1912. While it is possible that this construction may not result in the most efficient atomization or distribution of the nitrous oxide or fuel, it does provide a useful result without requiring the consumer to orient the spray bar 1910 in the plate 1902, or the manufacturer to incur any extra costs associated with making the spray bar 1910 angle-dependent. Other variations on the orifice pattern will be apparent to those of ordinary skill in the art, and this embodiment may even be used with a regular spray bar, such as that shown in FIG. 1, rather than one specifically made to obtain more even flow distribution around the bar's perimeter. Furthermore, it is envisioned that the spray bar 1910 may, instead of being perforated as shown in the embodiments herein, be formed of a porous material, such as sintered metal or plastic, provided the material can withstand the operating pressures of the nitrous and provides the desired flow rate.

In view of the foregoing description, it will be apparent that the present invention provides a new and useful device and method for providing nitrous oxide and additional fuel to an engine to enhance the engine's performance. Using the present invention, conventional nitrous plate systems that use oversized, fixed spray bars and interchangeable jets to adjust the nitrous and fuel flow rates can be replaced by interchangeable nitrous and fuel spray bars that are each sized to obtain the desired amount of nitrous and fuel delivery in a manner that may be more efficient than conventional devices. A user of the present invention tunes the device to his or her particular needs by replacing the fuel and nitrous spray bars to obtain the desired power increase and fuel/air ratio. To facilitate tuning, the fuel and nitrous spray bars are calibrated such that each successively "larger" or "smaller" spray bar provides a linearly-greater or lesser power gain.

Figure 20:
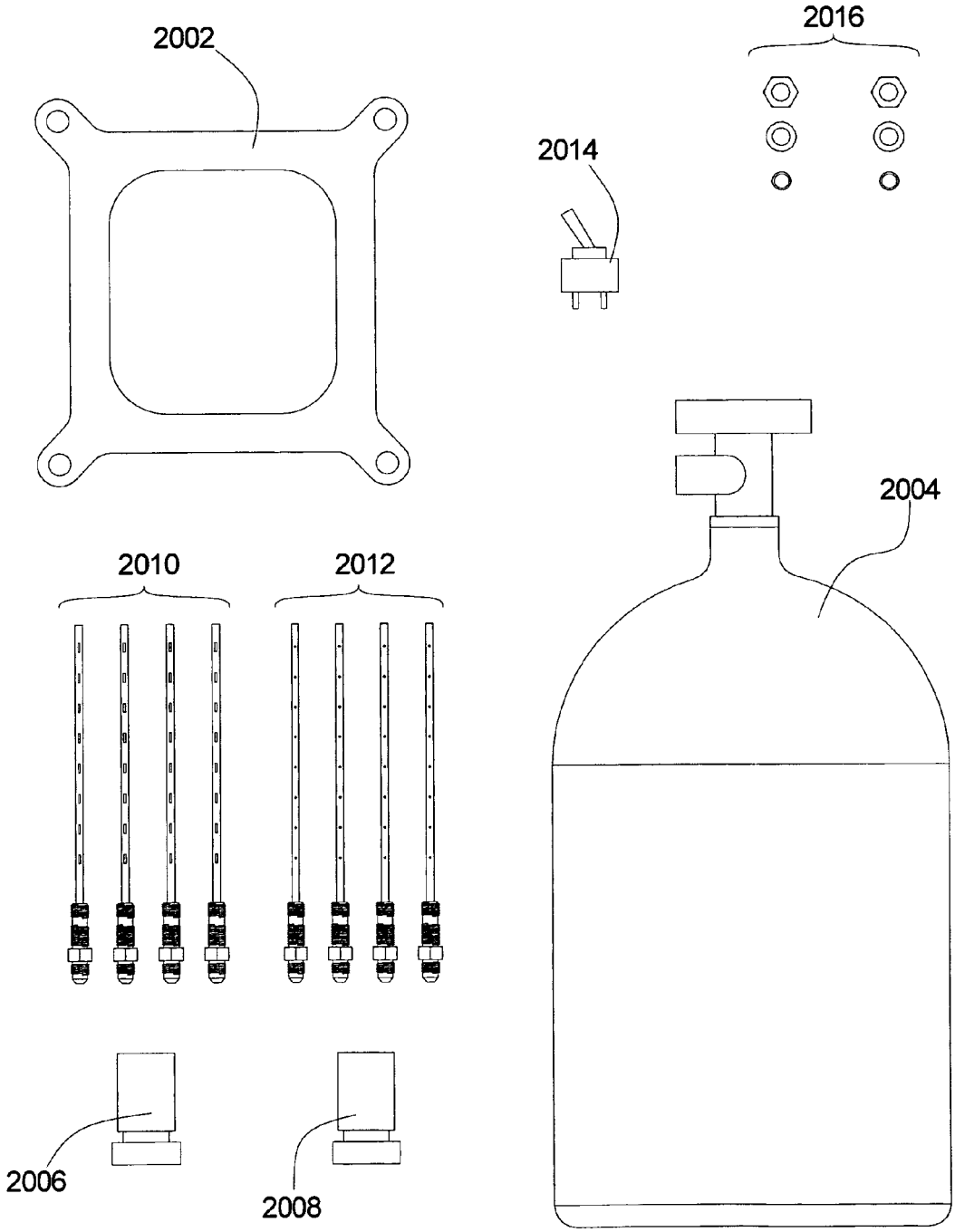
FIG. 20 is a plan view of an embodiment of a nitrous oxide kit of the present invention.

Referring to FIG. 20, in a preferred embodiment, the present invention is provided as a kit that consumers can use for installation into existing engines. In this embodiment, the kit includes: a nitrous plate 2002 that is adapted for use in a particular engine or set of engines; a nitrous supply bottle 2004; a nitrous flow control solenoid and/or pressure regulator 2006; a fuel flow control solenoid 2008; a set of interchangeable nitrous spray bars 2010, comprising various nitrous spray bars having different flow rates for a given nitrous pressure; a set of interchangeable fuel spray bars

2012, comprising various fuel spray bars having different flow rates for a given fuel pressure; an electrical switch 2014 for activating the solenoids 2006, 2008; jam nuts, washers and o-rings 2016 for use with the nitrous and fuel spray bars 2010, 2012; mounting brackets (not shown) for the nitrous bottle and solenoids; electrical wires and wire connectors (not shown) for use when installing the kit; and nitrous and fuel hoses and fittings (not shown) for use when installing the kit.

In one embodiment, a range of interchangeable nitrous spray bars 2010 are available, and a range of interchangeable fuel spray bars 2012 are available with the kit, or as supplemental parts. The nitrous spray bars 2010 can have a range of total nitrous delivery orifice areas of about 0.00125 $in^2$ to about 0.0125 $in^2$, but will more preferably be from about 0.0016 $in^2$ to about 0.0125 $in^2$. The fuel spray bars 2012 can have a range of total fuel delivery orifice areas of about 0.00125 $in^2$ to about 0.0125 $in^2$, but will more preferably be from about 0.0016 $in^2$ to about 0.0125 $in^2$. The user can select from among these various spray bars to obtain the desired fuel and nitrous flow rates. It will be appreciated that the total flow areas of the nitrous spray bar 2010 and the fuel spray bar 2012 may actually be the same to obtain the desired nitrous and fuel flow rates for particular applications, because the flow rate is proportional to the pressures of the nitrous and fuel systems, and these pressures may vary from application to application. For example, carbureted vehicles often provide fuel at a pressure of about 5 psi (pounds per square inch), while electronic fuel injected vehicles typically operate at 45-50 psi or more. In view of this, the nitrous spray bars 2010 and fuel spray bars 2012 may be interchangeable with one another to provide a more economical product.

Other variations are possible, and certain parts may be omitted or added to the kit. It will also be appreciated that the kit can be sold with a single set of nitrous and fuel spray bars 2010, 2012, and other interchangeable nitrous and fuel spray bars 2010, 2012 having different total nitrous and fuel flow rates may be sold as accessories to the kit.

In addition to providing benefits over known nitrous delivery systems, a further use for the present invention is to provide alternative fuels to power the engine or to supplement the flow of conventional fuels. Embodiments of the invention may be adapted to deliver alternative fuels, such as propane, alcohol, alcohol blended with other fuels, compressed and liquid natural gas and the like. Alternative fuels may be used to provide a cheaper, more efficient, cleaner, or otherwise desirable source of energy to internal combustion engines. Other alternative fuels, such as alcohol and alcohol blends, may also be useful for providing more powerful engines. The present invention may be used to deliver any of these fuels in addition to or in lieu of conventional gasoline, and may be adapted to deliver these fuels along with nitrous oxide. The nitrous plate described herein may also be used to temporarily power the engine using an alternative fuel, such as compressed natural gas, during certain portions of the operating cycle (e.g., protracted steady state operation), but operate on gasoline during other periods (e.g., start-up). The present invention provides a convenient and effective way to provide alternative fuel to both dedicated and hybrid alternative fuel engines. It is also envisioned that the nitrous oxide supply may be replaced by any other suitable oxidizer.

Other embodiments, uses and advantages of the invention will be apparent to those skilled in the art from consideration of the specification and practice of the invention disclosed herein. Furthermore, the present invention may be used in combination with conventional nitrous plate technology—for example, a nitrous plate system of the present invention may use an interchangeable nitrous spray bar as described herein, but a conventional fixed, jetted fuel bar as are known in the art, or vice-versa. An embodiment of the invention may also use any number of nitrous and/or fuel spray bars, which may be located and oriented in any desirable location, and operated in any number of stages (such as a two-stage system having cumulative flows of nitrous and/or fuel that are activated sequentially). For example, the nitrous plate may be provided with multiple fuel and nitrous spray bar ports, which all may be used, or only a portion of which may be used and the others plugged. The spray bars may also be curved or bent, rather than straight, as shown herein. The present invention may also be provided as an aftermarket conversion kit for existing nitrous plates. The specification (including the Abstract of the Invention) should be considered exemplary only, and the scope of the invention is limited solely by the following claims.

What is claimed is:

1. A nitrous oxide plate system comprising:

a plate adapted to fit in an intake pathway of an internal combustion engine, said plate having at least one central passage therethrough that forms a portion of said intake pathway when said plate is installed in said internal combustion engine;

a first spray bar port passing into said central passage;

at least two spray bars adapted to be interchangeably installed in said first spray bar port, said at least two spray bars comprising:

a first spray bar having a first plurality of distribution orifices having a first total area; and a second spray bar having a second plurality of distribution orifices having a second total area, wherein said second total area is different from said first total area.

2. The nitrous oxide plate system of claim 1, wherein said first spray bar and said second spray bar are adapted to pass a supply of nitrous oxide or a supply of fuel into said central passage.

3. The nitrous oxide plate system of claim 1, wherein said first spray bar and said second spray bar are fixed against rotation when installed in said first spray bar port.

4. The nitrous oxide plate system of claim 1, further comprising means to fix said first spray bar and said second spray bar against rotation when installed in said first spray bar port.

5. The nitrous oxide plate system of claim 4, wherein said means to fix said first spray bar and said second spray bar against rotation when installed in said first spray bar port comprises a locking fitment between said first spray bar and said plate and said second spray bar and said plate, said locking fitment comprising a jam nut, a set screw, a key, or non-rotatable shape.

6. The nitrous oxide plate system of claim 1, wherein:

said first spray bar comprises a first threaded hollow fitting rigidly attached to a first end of said first spray bar and forming a continuous hollow passage into said first spray bar, and a first closure plate rigidly attached to a second end of said first spray bar;

said second spray bar comprises a second threaded hollow fitting rigidly attached to a first end of said second spray bar and forming a continuous hollow passage into said second spray bar, and a second closure plate rigidly attached to a second end of said second spray bar; and wherein said first threaded hollow fitting and said second threaded hollow fitting are interchangeably threadable into said first spray bar port.

7. The nitrous oxide plate system of claim 1, wherein said nitrous oxide plate system further comprises:

a second spray bar port passing into said central passage; and at least two additional spray bars adapted to be interchangeably installed in said second spray bar port, said at least two additional spray bars comprising:

a third spray bar having a third plurality of distribution orifices having a third total area; and a fourth spray bar having a fourth plurality of distribution orifices having a fourth total area, wherein said fourth total area is different from said third total area.

8. The nitrous oxide plate system of claim 7, wherein said first spray bar and said second spray bar are adapted to pass a supply of nitrous oxide into said central passage, and said third spray bar and said fourth spray bar are adapted to pass a supply of fuel into said central passage.

9. The nitrous oxide plate system of claim 8, wherein at least one of said first, second, third and fourth pluralities of distribution orifices comprise round openings and at least an other of said first, second, third and fourth pluralities of distribution orifices comprise elongated openings.

10. The nitrous oxide plate system of claim 8, further comprising:

a nitrous oxide valve fluidly connectable between said first spray bar port and a supply of nitrous oxide and adapted to control a flow of nitrous oxide therebetween;

a fuel valve fluidly connectable between said second spray bar port and a supply of fuel and adapted to control a flow of fuel therebetween; and at least one switch operable to control at least one of said nitrous oxide valve and said fuel valve.

11. The nitrous oxide plate system of claim 7, wherein said first spray bar and said second spray bar are adapted to pass a first supply of nitrous oxide into said central passage, and said third spray bar and said fourth spray bar are adapted to pass a second supply of nitrous oxide into said central passage.

12. An interchangeable spray bar for a nitrous oxide plate system, said interchangeable spray bar comprising:

a hollow tube having an interior tube passage, an outer wall, a first end, a second end, and a plurality of distribution orifices passing through said outer wall;

a fitting adapted to adjoin said first end of said hollow tube, said fitting having a hollow fitting passage therethrough in fluid communication with said interior tube passage when said fitting is adjoining said hollow tube, wherein said hollow tube is adapted to removably fit within a nitrous oxide plate, and said fitting is adapted to engage said nitrous oxide plate to thereby hold said hollow tube within said nitrous oxide plate, said fitting also having a first threaded portion adapted to threadingly engage a corresponding threaded hole in said nitrous oxide plate, and a second threaded portion adjacent said first threaded portion;

a jam nut adapted to threadingly engage said second threaded portion of fitting; and an integral nut adapted to engage said fitting.

13. The interchangeable spray bar of claim 12, further comprising a closure plate attached to said second end of said hollow tube to thereby prevent fluid communication therethrough.

14. The interchangeable spray bar of claim 12, wherein said fitting is adapted to hold said hollow tube within said nitrous oxide plate in an axial direction along a length of said hollow tube, and in a rotational direction around a circumference of said hollow tube.

15. The interchangeable spray bar of claim 12, wherein said distribution orifices are round, oblong, rectangular or a combination thereof.

16. The interchangeable spray bar of claim 12, wherein said fitting is rigidly connected to said first end of said hollow tube to thereby prevent independent axial or rotational movement between said fitting and said hollow tube.

17. The interchangeable spray bar of claim 12, wherein said fitting further comprises a third threaded portion adapted to threadingly engage a nitrous oxide supply hose fitting.

18. The interchangeable spray bar of claim 12, wherein a cross-sectional area of said interior tube passage varies between said first end and said second end.

19. The interchangeable spray bar of claim 18, wherein said cross-sectional area decreases toward said second end.

20. The interchangeable spray bar of claim 12, wherein said plurality of distribution orifices comprise at least two orifices having different sizes from one another.

21. A nitrous oxide plate system comprising:

a plate adapted to fit in an intake pathway of an internal combustion engine, said plate having at least one central passage therethrough that forms a portion of said intake pathway when said plate is installed in said internal combustion engine;

a first nitrous spray bar port passing into said central passage;

a plurality of nitrous spray bars, said plurality of nitrous spray bars being adapted to be interchangeably installed into said first nitrous spray bar port and project into said central passage when installed; said plurality of nitrous spray bars comprising:

at least a first nitrous spray bar having a first total nitrous distribution orifice area; and at least a second nitrous spray bar having a second total nitrous distribution orifice area, said second total nitrous distribution orifice area being different from said first total nitrous distribution orifice area.

22. The nitrous oxide plate system of claim 21, further comprising:

a second nitrous spray bar port passing into said central passage;

a plurality of secondary nitrous spray bars, said plurality of secondary nitrous spray bars being adapted to be interchangeably installed into said secondary nitrous spray bar port and project into said central passage when installed; said plurality of secondary nitrous spray bars comprising:

at least a first secondary nitrous spray bar having a first total secondary nitrous distribution orifice area; and at least a second secondary nitrous spray bar having a second total secondary nitrous distribution orifice area, said second total secondary nitrous distribution orifice area being different from said first total secondary nitrous distribution orifice area.

23. The nitrous oxide plate system of claim 21, further comprising:

a first fuel spray bar port passing into said central passage;

a plurality of fuel spray bars, said plurality of fuel spray bars being adapted to be interchangeably installed into said first fuel spray bar port and project into said central passage when installed; said plurality of fuel spray bars comprising:

at least a first fuel spray bar having a first total fuel distribution orifice area; and at least a second fuel spray bar having a second total fuel distribution orifice area, said second total fuel distribution orifice area being different from said first total fuel distribution orifice area.

24. The nitrous oxide plate system of claim 23, further comprising:

a secondary nitrous spray bar port passing into said central passage; and a secondary fuel spray bar port passing into said central passage.

25. The nitrous oxide plate system of claim 24, further comprising:

a plurality of secondary nitrous spray bars, said plurality of secondary nitrous spray bars being adapted to be interchangeably installed into said secondary nitrous spray bar port and project into said central passage when installed; said plurality of secondary nitrous spray bars comprising:

at least a first secondary nitrous spray bar having a first total secondary nitrous distribution orifice area;

at least a second secondary nitrous spray bar having a second total secondary nitrous distribution orifice area, said second total secondary nitrous distribution orifice area being different from said first total secondary nitrous distribution orifice area;

a plurality of secondary fuel spray bars, said plurality of secondary fuel spray bars being adapted to be interchangeably installed into said secondary fuel spray bar port and project into said central passage when installed; said plurality of secondary fuel spray bars comprising:

at least a first secondary fuel spray bar having a first total secondary fuel distribution orifice area; and at least a second secondary fuel spray bar having a second total secondary fuel distribution orifice area, said second total secondary fuel distribution orifice area being different from said first total secondary fuel distribution orifice area.

26. The nitrous oxide plate system of claim 21, wherein said nitrous oxide plate system comprises: a single-stage dry nitrous system, a multi-stage dry nitrous system, a single stage wet nitrous system, or a multi-stage wet nitrous system.

* * * * *